United States Patent [19]

Do

[11] Patent Number: 5,026,212

[45] Date of Patent: Jun. 25, 1991

[54] APPARATUS FOR THE COMBATTING OF MARINE GROWTH ON OFFSHORE STRUCTURES

[75] Inventor: Christopher N. Do, Damansara Utama, Malaysia

[73] Assignee: IEV International Pty. Limited, Malaysia

[21] Appl. No.: 439,353

[22] PCT Filed: May 13, 1988

[86] PCT No.: PCT/AU88/00139

§ 371 Date: Nov. 6, 1989

§ 102(e) Date: Nov. 6, 1989

[87] PCT Pub. No.: WO88/08808

PCT Pub. Date: Nov. 17, 1988

[30] Foreign Application Priority Data

May 15, 1987 [AU] Australia ..... PI1958

[51] Int. Cl.[5] ..... E02D 5/60

[52] U.S. Cl. ..... 405/211; 405/195

[58] Field of Search ..... 405/211, 195, 60, 216; 134/42; 114/222

[56] References Cited

U.S. PATENT DOCUMENTS

| | | | |
|---|---|---|---|
| 1,008,669 | 11/1911 | Nixon | 405/211 |
| 1,036,907 | 8/1912 | Reynolds | 405/211 |
| 1,134,881 | 4/1915 | Lockwood | 405/211 |
| 1,266,050 | 5/1918 | Reynolds | 405/211 |
| 1,266,051 | 5/1918 | Reynolds | 405/211 |
| 1,279,732 | 9/1918 | Lockwood | 405/211 |
| 4,676,692 | 6/1987 | Henderson | 405/211 |

*Primary Examiner*—Dennis L. Taylor

*Attorney, Agent, or Firm*—Banner, Birch, McKie & Beckett

[57] ABSTRACT

Apparatus for removing marine growth from offshore marine structures, said apparatus comprising flexible multi-component floating rings and submerged rings being adapted to surround a structural support member of the offshore marine structure, the apparatus being powered by the utilization of ocean forces in the form of waves, swells, tides and currents so that marine growth is removed from the structural support member by means of the reciprocating motion of the apparatus about the structural support member.

3 Claims, 6 Drawing Sheets

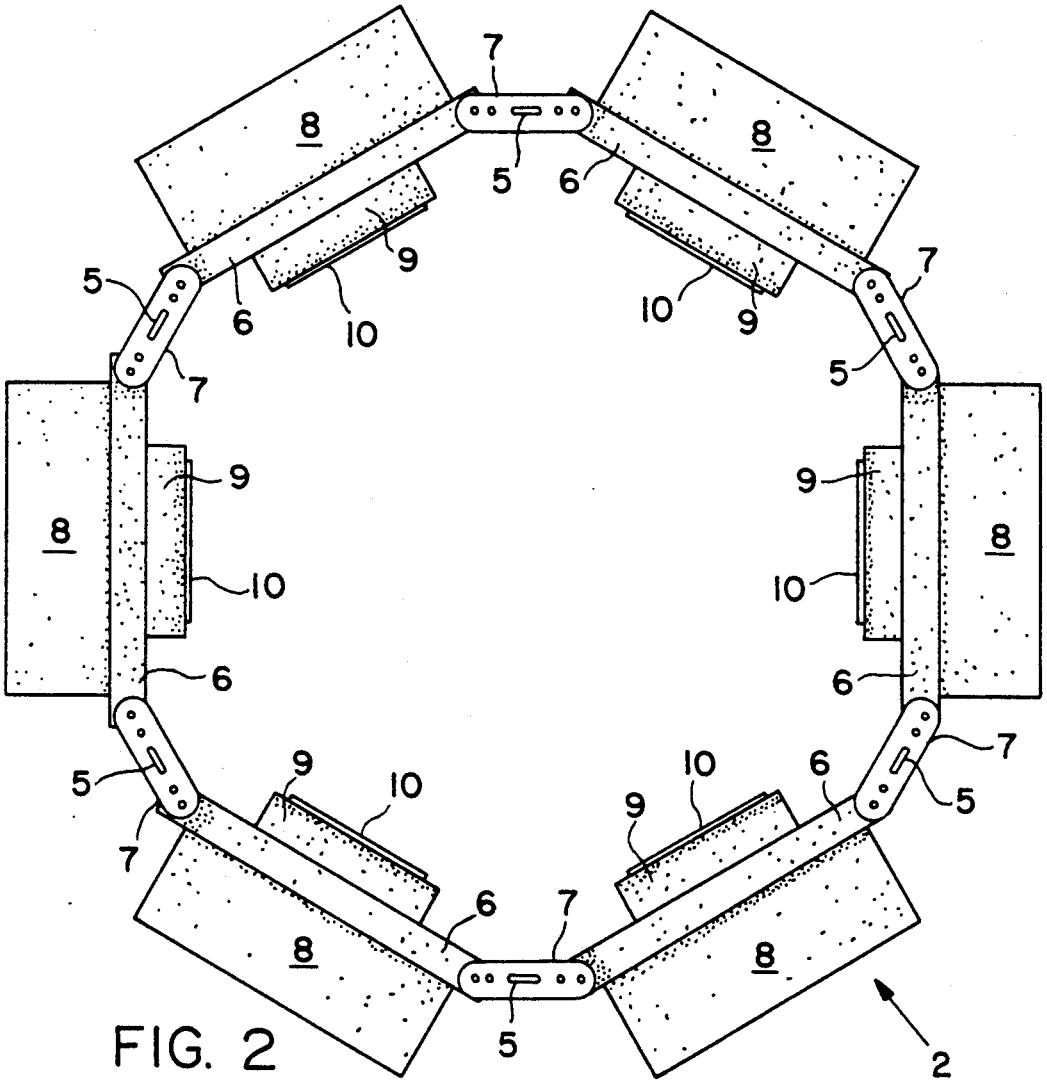
FIG. 2
FIG. 3
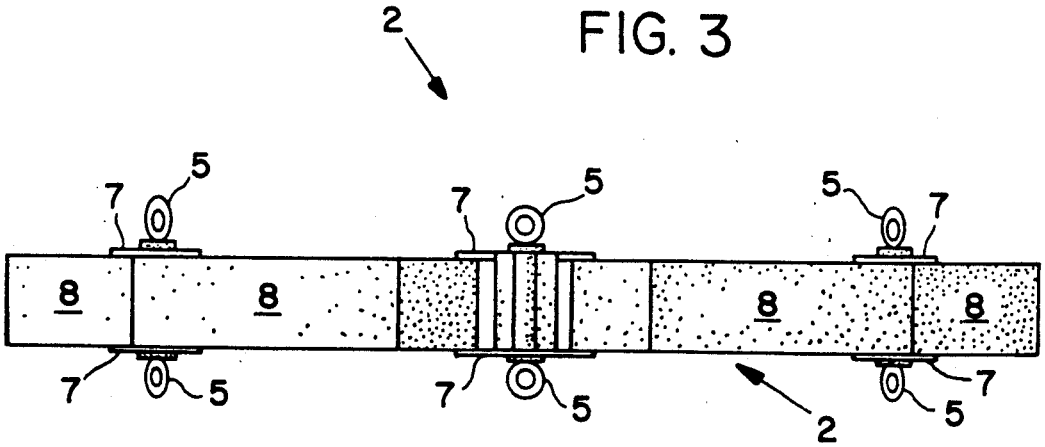

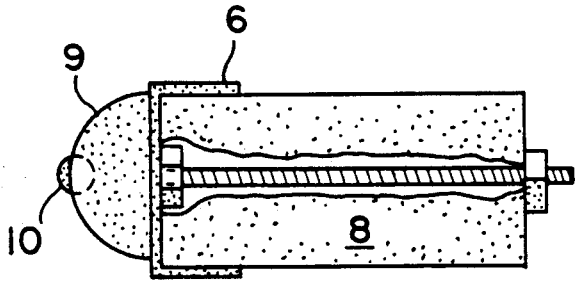
FIG. 4
FIG. 5
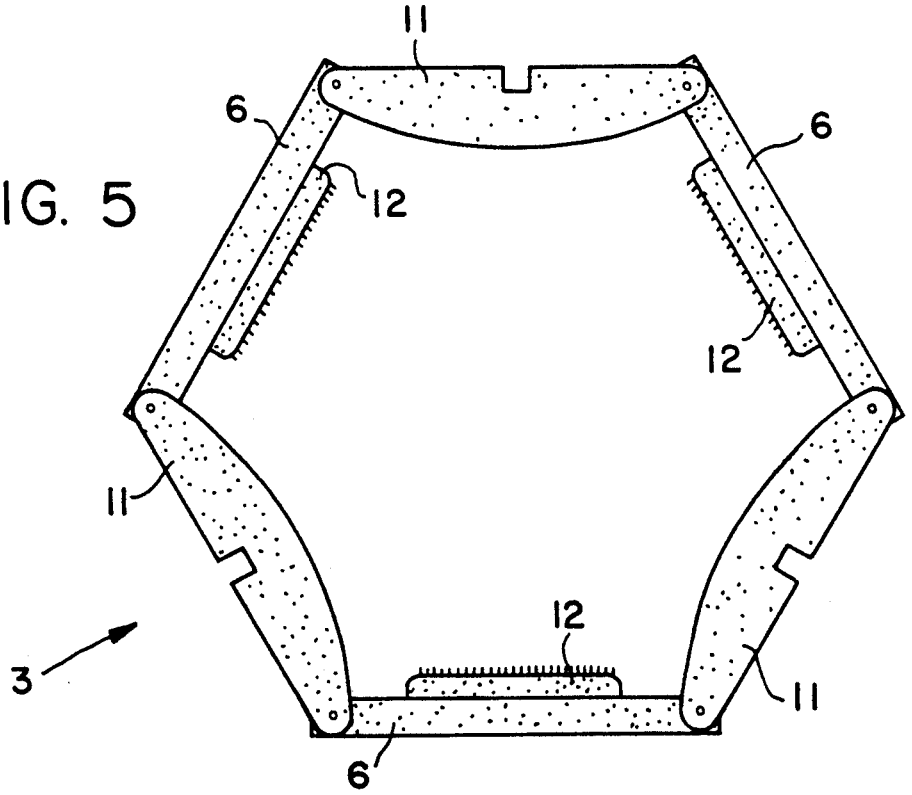
FIG. 6
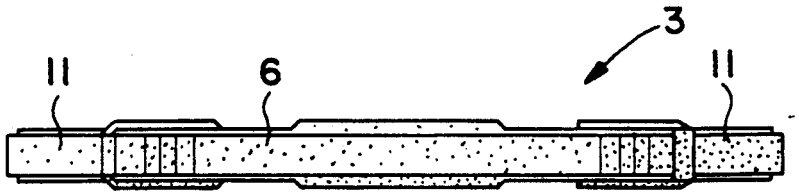

APPARATUS FOR THE COMBATTING OF MARINE GROWTH ON OFFSHORE STRUCTURES

TECHNICAL FIELD

This invention relates to the removal and prevention of marine growth affecting marine platforms, underwater structures and the like, and more particularly to cost-effective means for controlling and combatting such marine growth by the use of natural forces to power apparatus for removing, and for preventing regrowth of, such fouling growth as occurs on water-line or splash zone and submerged structural components of, say, offshore oil platforms or "rigs".

BACKGROUND ART

Marine growth, in particular hard-fouling organisms such as barnacles, oysters and tubeworms together with soft-fouling organisms such as anemones and hydroid sponges, have long been recognised as a major cause of problems which affect the integrity of structures submerged in seawater in a number of ways:

Such marine growth adds detrimental extra mass to a submerged structure.

It increases the roughness of exposed surfaces, thus increasing the hydro-dynamic loading, on a structure.

It enlarges the dimensions of underwater members such as legs, underpinnings, struts, etc., and hence the surface areas of structures subjected to fluid loading.

It obscures underwater surfaces, thus preventing necessary visual surveillance.

Periodical removal of such marine fouling by careening and scraping has been employed as a principal means of controlling marine growth fouling on offshore oil platforms for decades. Traditionally, copper-plating and, later, Muntz metal-plating were used on ships' hulls and, recently, marine growth inhibition has again been realised by the introduction of anti-fouling paints and other anti-fouling materials such as plates or panels of cupro-nickel tightly fitted to cleaned members. These methods, however, have become prohibitively expensive both because of the time-consuming and costly diving operations involved and because of the anti-fouling materials used.

DISCLOSURE OF THE INVENTION

It is therefore an object of the present invention to overcome the above and other disadvantages by the provision of apparatus for the combatting of marine growth on marine-based structures.

To this end, then, in a first aspect, the invention consists in apparatus adapted to surround a submerged member and to scrape marine growth therefrom; this apparatus being powered by utilization of ocean forces such as waves, swells, tides and currents.

In a second aspect, the invention also consists in apparatus adapted to surround a submerged member and to prevent marine growth from re-establishing on the member, this apparatus again being powered by utilization of ocean forces.

Thus, the present invention consists in apparatus for the combatting of marine growth on underwater structures, the apparatus being adapted to surround a submerged member of a said structure and to either scrape marine growth therefrom, or prevent marine growth from re-establishing thereon; characterized in that the said apparatus is powered by utilization of ocean forces in the form of waves, swells, tides and currents.

BRIEF DESCRIPTION OF THE DRAWINGS

In order that the reader may gain a better understanding of the invention, hereinafter will be described certain preferred embodiments thereof, by way of example only and with reference to the accompanying drawings in which:

FIG. 2 is a plan view of a floating ring;

FIG. 3 is a corresponding side elevation;

FIG. 4 is an end element of the floating ring of FIGS. 2 and 3;

FIG. 5 is a plan view of a submerged ring;

FIG. 6 is a corresponding side elevation;

Throughout the drawings, like integers are referenced by the same numeral.

BEST MODES FOR CARRYING OUT THE INVENTION

Figure 1:
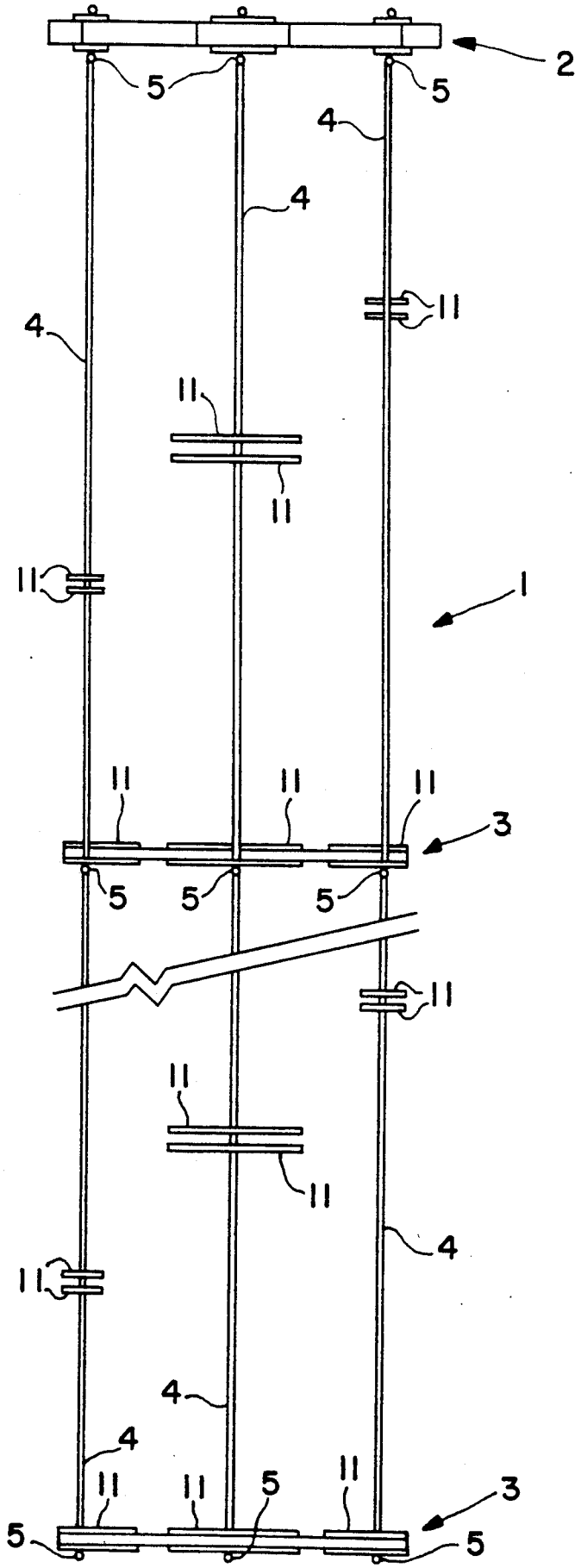
FIG. 1 is a side elevation of a first embodiment of a marine growth remover in accordance with the present invention.

The apparatus shown in FIG. 1 and generally referenced 1 includes a floating or drive ring, generally referenced 2, and at least one submerged or driven ring, generally referenced 3, connected by a number of linkages 4. In addition to these rings, single scraper blades 11 may be located on the linkages — these single scraper blades will be described hereinafter with reference to FIGS. 5 and 6. Linkages 4 are preferably of RHS steel tubing with holes pre-drilled at various positions for attachment of submerged rings 3 and separate scraper blades 11.

The linkages 4 may well be filled with flotation material for additional buoyancy, and they are ideally from 1 m. to 3 m. in length. Each linkage 4 is provided, at each end, with an eye 5.

The positions of the submerged rings 3 and separate blades on linkages 4 can be adjusted to suit particular sea conditions and is able to accommodate sea fluctuations of from 2 m. up to 8 m. Needless to say, when in use, floating ring 2 and submerged rings 3 surround the structural member to be cleansed of marine growth.

As will be seen from FIGS. 2 and 3, floating ring 2 is comprised of a number — in this case six — of identical cleaning bars 6 linked together, to constitute a cleaning collar, via hinge members 7. Each cleaning bar 6 is provided with one or more demountable flotation blocks 8 of sufficient volume to together buoy up ring 2 and its associated appurtenances. Also attached to each cleaning bar 6 is a cleaning member 9 of semi-circular cross-section — see FIG. 4 — which is provided with a roller 10. The member 9 and its roller 10 are preferably fabricated from a highly abrasion- and impact-resistant plastic material such as "RALLOY" ultra high molecular weight high density polyethylene.

Floating ring 2, while shown as having six cleaning bars, has, however, no specific geometry as the number of bars 6 will vary with the diameter of the submerged member to be cleaned This enables floating rings of various configurations to be produced without having to change the size of the components, which are made identical for this purpose.

Under wave forces, the flexible floating ring 2 conforms to the circumference of a submerged member and thus allows several simultaneous points of contact for cleaning. The cleaning productivity offered by this flexible ring 2 is therefore much higher than that of a rigid ring, in addition to the ease of mass production and transportation achievable. The cleaning members act to remove fouling marine growth from submerged members by continuous hammering action generated by movement in response to ocean forces. Roller 10 rotates freely when making contact with the submerged member and, consequently, through its low rotational friction coefficient, it cleans the substratum without causing damage to protective coatings.

In some applications it is required to be able to remove corrosion products and damaged paint to provide a surface suitable for the application of protective surface coatings. To this end the cleaning member 9 may be replaced by a member comprising scrapers and or wire brushes and the like.

Turning now to FIGS. 5 and 6, submerged ring 3 has no flotation blocks but, as movement of these rings is not as vigorous as that of a floating ring 2 owing to the absence of lateral wave forces, its cleaning elements have sharper rubbing or scraping edges to enhance cleaning efficiency. Both kinds of ring have that high degree of flexibility required to accommodate differing sizes of submerged members and various thicknesses of marine growth.

Submerged ring 3 includes a number of identical cleaning bars, again referenced 6, pivoted to an equal number of scraper blades 11. Each cleaning bar 6 carries a steel wire brush 12; cleaning bars 6, scraper blades 11 and brushes 12 are made from steel and may be provided with suitable protective coatings.

As in the case of floating ring 2, the selection of shapes for the floating and submerged rings is dictated largely by the following factors:

i) aerodynamic characteristics; facilitation of rotational movement of the ring under lateral fluid and/or wind loading;

ii) cleaning effectiveness; rings clean more effectively and are less prone to impact damage if there are more points of contact between the ring and the member to be cleaned; and iii) ease of fabrication, transportation and installation.

While the blades 11 are provided to initially scrape both hard and soft marine organisms off submerged members below the "splash zone", the wire brushes 12 subsequently remove calcareous deposits and bacterial slime to produce a so-called "Class 1" or higher "Swedish Grade" finish on the cleaned member.

It should be noted that the scraper blades 11 are also those used as the separate blades mounted on the linkages 4.

Figure 7:
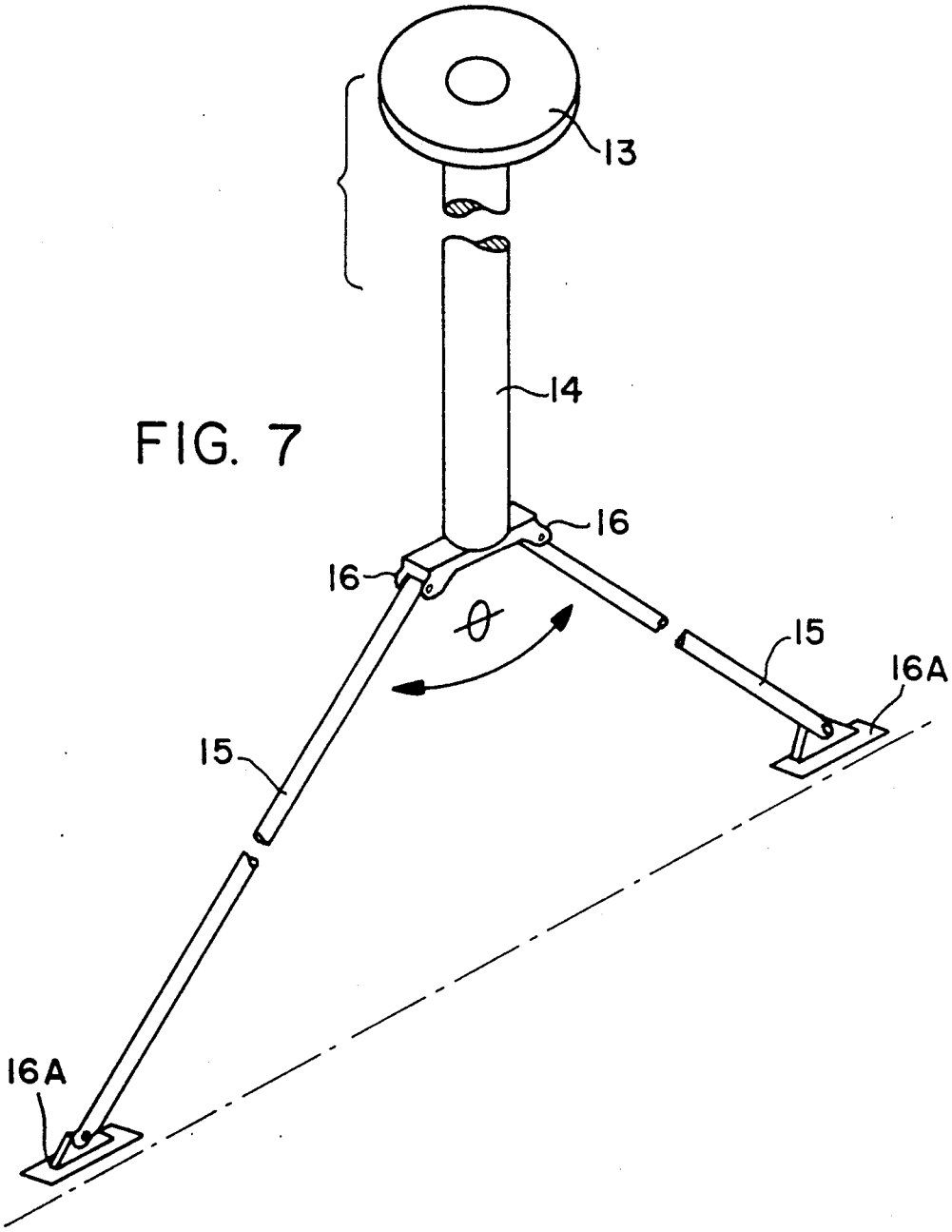
FIG. 7 is a fragmented representation of an inverted Y-frame for supporting horizontally - acting rings.

The apparatus for marine growth removal as described above with reference to FIGS. 1 to 6 of the drawings is especially adapted to remove befouling marine growth from vertically- or inclinedly-disposed submerged structural members, the floating ring cleaning through the splash zone and followed up by the or each submerged ring The present invention also contemplates the removal of marine growth from horizontal submerged structural members of offshore structures and to this end the reader's attention is drawn to FIG. 7 of the drawings In this embodiment, a float disc 13 moves upwardly and downwardly with respect to an underwater structure, taking with it a drive shaft 14 which, in turn, moves a pair of link arms 15 — pivoted to the lower end of drive shaft 14 at 16 — so as to vary the angle $\phi$ between link arms 15 At the lower ends of links arms 15 are slide elements 16 A which have connected thereto a spaced-apart pair of marine growth removing rings much as described in relation to FIGS. 2 to 6.

When float 13 moves upwards with respect to an underwater structure it pulls with it drive shaft 14 which in turn pulls the pair of link arms 15 upwards so as to lessen the angle $\phi$ between the arms. As a result, the spaced-apart submerged rings are enabled to move reciprocally along the horizontal member When float 13 moves downwardly on the ocean surface the reverse actions occur. The rings are similar in construction to the submerged rings previously described Connections between arms 15 and the rings are combinations of pin and slide connectors to allow vertical forces to be transformed into horizontal forces at all arm angles. The depth of the driving shaft 14 varies with the length and depth of the horizontal member being cleaned. Drive shaft 14 is preferably fabricated from steel pipe filled with flotation material; the position of float 13 on shaft 14 can be varied to accommodate the cleaning depth required. Although float 13 may have any shape provided it gives sufficient buoyancy to the apparatus, the preferred one is discoid as its tendency to rotate under ocean forces is minimised, and maximum lifting forces are obtained. Lateral movement of the apparatus under natural forces such as waves, swells, tides and currents has to be limited to ensure that vertical forces exerted on float 13 are transmitted into useful horizontal forces for the cleaning actions. This is achieved by securing the drive shaft at an appropriate position on the offshore oil rig or other marine platform.

The marine growth removing apparatus described above are adapted to travel along members, powered by the vigorous and endless movement of the ocean's surface, which is made up of waves, swells, tide and currents. Once installed, marine fouling and growth is quickly removed by the scraping and rubbing actions leaving the so-called "Class 1" or higher "Swedish Grade" finish on the members'surfaces.

Various materials may be employed in the construction of these marine growth removers, ranging from metallic, e.g., steel, aluminium, etc., to non-metallic materials such as plastic or wood. The properties required are: durability; low cost; light weight; anti-abrasion; and anti-corrosion.

Figure 8:
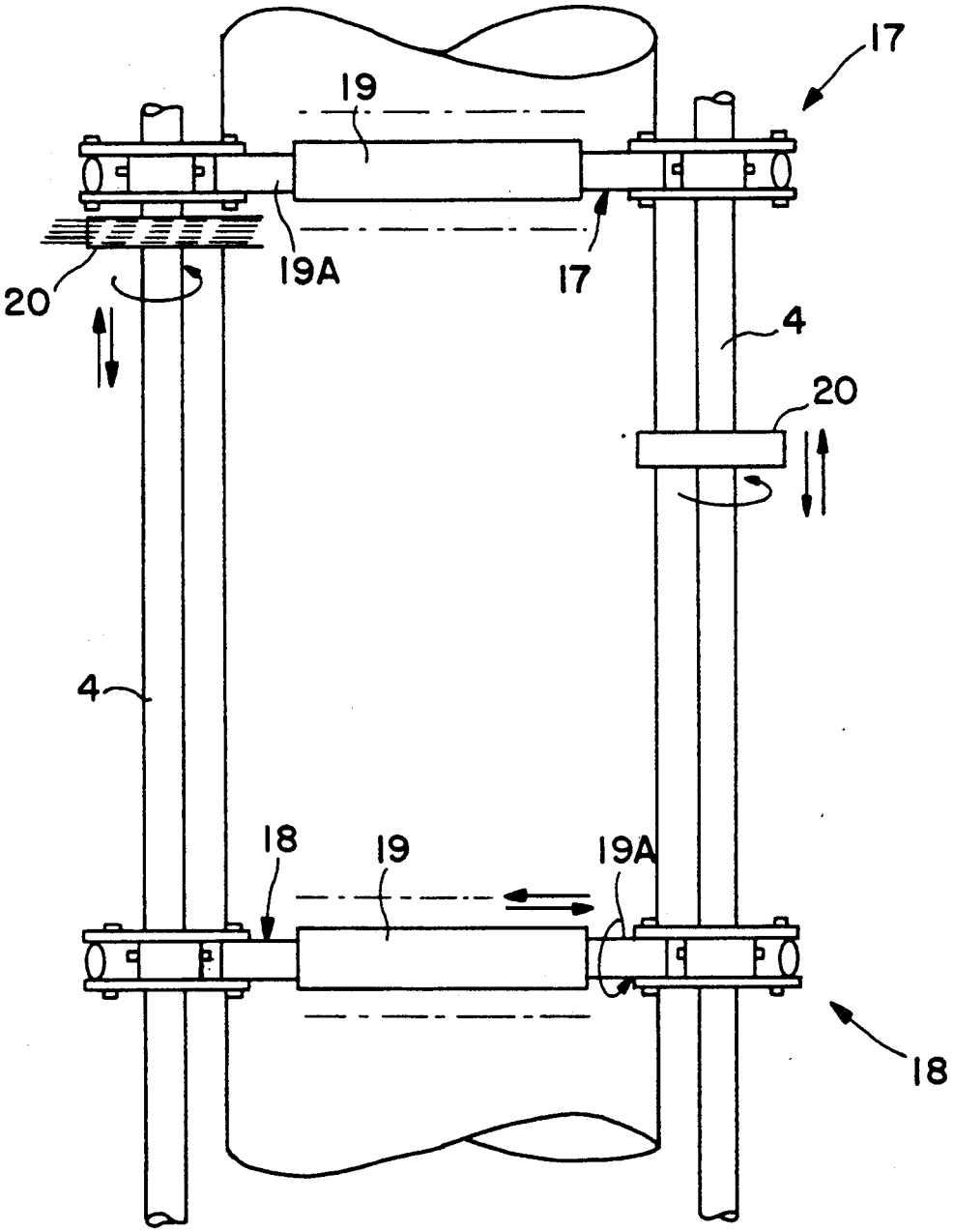
FIG. 8 is a side elevation of a marine growth preventer according to the present invention.
Figure 9:
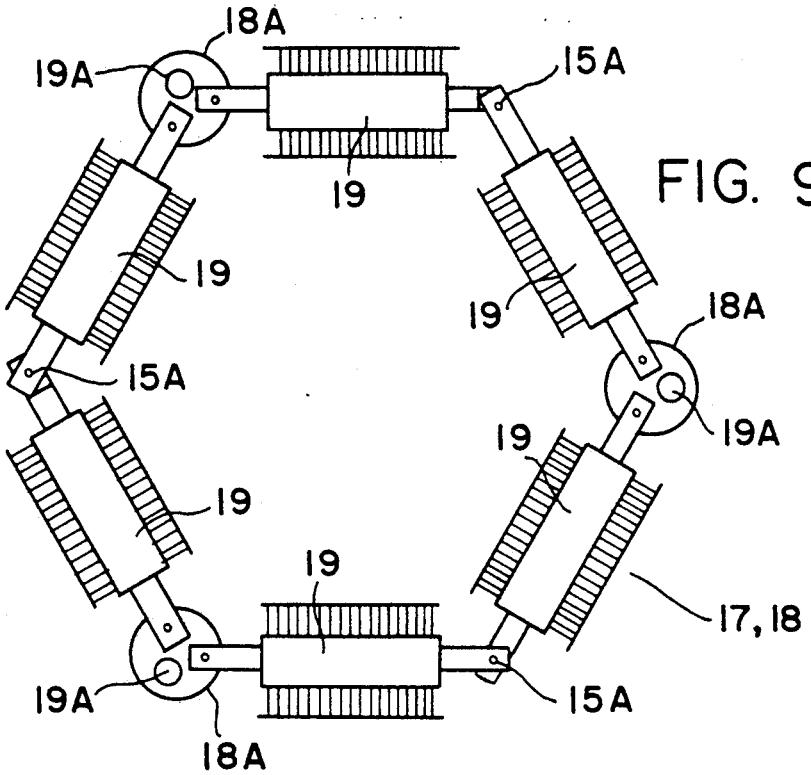
FIG. 9 is a plan view of a marine growth preventer ring.

The invention may also consist in marine fouling and growth prevention apparatus, as is to be seen in FIGS. 8 and 9.

This apparatus is adapted to be installed around previously cleaned members and although it operates on the same principle as the removing apparatus, it does not require the strength and riqidity to resist impact loading caused by violent contact with marine growth while travelling up and down with the ocean surface. Nevertheless, it should be capable of surviving severe storms and heavy seas during its working life. This may be achieved mainly by reducing impact loading to a minimum through the tight fitting of the preventers to the previously cleaned members.

Figure 11:
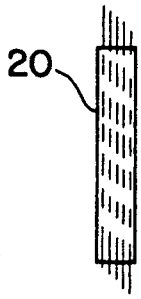
FIG. 11 is a schematic side elevation of a disc brush.

Basically, an inventive marine growth prevention apparatus consists in spaced-apart, multi-component pivotally- or flexibly-linked "rings" 17 and 18, in which arrangement roller brushes 19 alternate with link disks 18 A and pivotal connections 15 A, again to form a multi-linked flexible collar, the brushes 19 taking the place of the cleaning bars of the marine growth removers. Again, the flexible collars or rings 17 are arranged in spaced-apart relationships being connected via a number of connecting rods or linkages 4 (as in FIG. 1) connected to the rings 17 via the link rod brushes 19 A. Moreover, linkages 4 may each bear a cleaning disc brush 20; the bristles borne on rollers 19 and discs 20 may be of metal, plastic or organic material. Both the rollers and the discs are able to rotate freely on the components of the apparatus. The link discs 18 A may also incorporate radially-directed fins (not shown) to encourage or to facilitate rotation of the rings 17, 18 about the column or member to be cleaned. FIG. 11 schematically shows how a disc's bristles may be angularly located so as to create vertical movement and so that their discs respond to current forces in both rotational and transitional movement.

Disc brushes 20, having positive buoyancy travel downwards when subjected to lateral fluid loading, and vice versa. Such thick arrays of brushes provide good protection of cleaned surfaces and effectively prevent marine regrowth.

Figure 10:
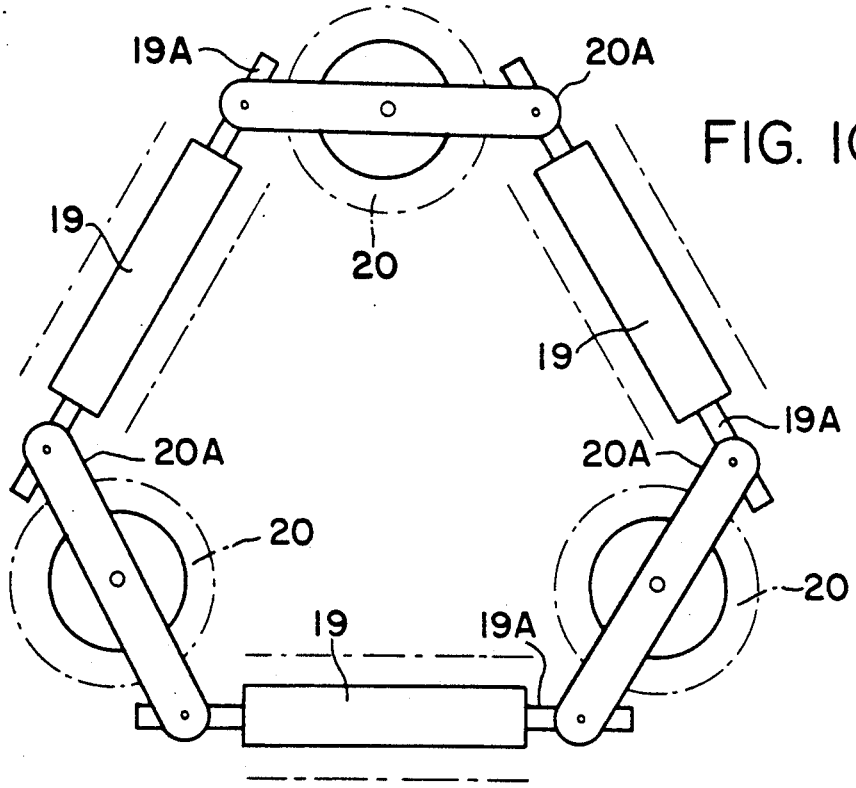
FIG. 10 is a plan view of a horizontal marine growth preventer ring.

FIG. 10 illustrates a multi-link flexible marine growth preventer ring or collar for surrounding horizontal members. These preventers are driven mainly by current forces; both the transitional and rotational movements take place so as to produce a complete brushing coverage on all the component parts. Unlike those fitted on vertical members, single bristle-bearing rings are used to prevent fouling regrowth on horizontal members. Pivotal connections connect the brackets or plates 20 A roller brushes 19 of each ring.

The continuous brushing action of the apparatus against the surface of a member prevents re-establishment of fouling organisms, and consequently maintains the submerged structure free of marine growth and other fouling. The cost of replacing rollers and discs, periodically, over the working life of the whole structure is insignificant in comparison with conventional periodical cleaning operations.

Important parameters in the selection of materials adapted to resist both wear and deterioration in sea water include:

all parts subject to wear and caused by contact with members should be easily replaceable;

all cross-sections should be adapted so as to give the least resistance and the minimum drag co-efficient on exposure to fluid loading;

impact of marine growth preventers on seadeck members or submerged horizontal members should be totally avoided by the incorporation of an inertia element into the structure, in known manner.

In an unillustrated variation, marine growth preventer rings may be especially adapted for use on both horizontal and diagonally-disposed structural members at underwater (including very deep) locations by incorporating fins or vanes into the ring. The fins may be pivotally attached to the rings and are generally radially directed. Since preventer rings are primarily driven by current forces which generate both transitional and rotational movement, the fins act to increase the ring's response to lateral water forces.

In the case of preventer rings on deep, diagonally-disposed structural members, such fins may be given configurations such that the ring is driven downwardly under lateral current forces; when such forces are removed, or at least re-directed, the natural buoyancy of the mainly plastic ring components cause the ring to move more upwardly along the member.

The installation and recovery of the inventive marine growth devices can be carried out above water by the employment of purpose-built platforms, or by employing divers, depending upon location, underwater.

INDUSTRIAL APPLICABILITY

The present invention has its main application in shallow water oil-rig platforms since the primary power source is tide, waves, wind and currents. Such a location may well be where a combination of light fluid loading, density and sheer size of fouling growth — particularly hard growth such as barnacles, oysters, tubeworms and/or limpets — constitute to greatest overturning moments, thus, the need to combat marine growth is of the utmost importance.

From the abovegoing, it will be readily appreciated by those skilled in the art that variations and modifications may be made to the invention without departing from the spirit and scope thereof, described.

I claim:

1. Apparatus for the combatting of marine growth on offshore marine structures, said apparatus being adapted to surround a submerged structural support member of said structure and to scrape marine growth therefrom, said apparatus being powered by utilization of ocean forces in the form of waves, swells, tides and currents; said apparatus comprising:

a floating ring and at least one submerged ring connected thereto in spaced apart array by linking members disposed substantially parallel to said submerged structural support member so that said rings surround said submerged structural support member;

said floating ring including a plurality of cleaning bars linked together via hinge members to thereby constitute a flexible cleaning collar, each cleaning bar having attached thereto a cleaning member provided with a non-metallic, submerged structural support member-engaging roller and one or more detachable flotation blocks of sufficient volume to buoy up the apparatus, said cleaning member acting to remove marine growth by a continuous hammering action generated in response to said ocean forces; and said at least one submerged ring including a plurality of cleaning bars linked together via an equal plurality of scraper blades to thereby constitute a flexible cleaning collar, each submerged cleaning bar being provided with a wire brush, said scraper blades and wire brushes being adapted to engage said submerged structural support member.

2. Apparatus as claimed in claim 1, wherein each said linkage has mounted thereon a plurality of scraper blades adapted to engage said submerged structural support member.

3. Apparatus as claimed in claim 1, wherein said linkages are filled with flotation material.

* * * * *